US007954500B2

(12) United States Patent
Dumler et al.

(10) Patent No.: US 7,954,500 B2
(45) Date of Patent: Jun. 7, 2011

(54) APPLICATION FOR A COSMETIC PRODUCT, ESPECIALLY FOR MASCARA OR HAIR DYE

(75) Inventors: Norbert Dumler, Ansbach (DE); Daniela Kulik, Feuchtwangen (DE)

(73) Assignee: Geka Brush GmbH, Bechhofen (DE)

( * ) Notice: Subject to any disclaimer, the term of this patent is extended or adjusted under 35 U.S.C. 154(b) by 0 days.

(21) Appl. No.: 11/501,102

(22) Filed: Aug. 9, 2006

(65) Prior Publication Data

US 2007/0034223 A1 Feb. 15, 2007

(30) Foreign Application Priority Data

Aug. 11, 2005 (EP) ..... 05017439

(51) Int. Cl.
*A45D 40/26* (2006.01)

(52) U.S. Cl. ..... 132/218

(58) Field of Classification Search ..... 132/218, 132/152, 153
See application file for complete search history.

(56) References Cited

U.S. PATENT DOCUMENTS

| | | | | |
|---|---|---|---|---|
| 3,892,248 | A | 7/1975 | Kingsford | |
| 3,982,248 | A | 9/1976 | Archer | |
| 4,527,575 | A * | 7/1985 | Vasas | 132/218 |
| 4,744,377 | A | 5/1988 | Dolan, Jr. | |
| 4,927,281 | A * | 5/1990 | Gueret | 401/129 |
| 5,224,787 | A * | 7/1993 | Vasas | 401/119 |
| D445,573 | S * | 7/2001 | Naghibi | D4/136 |
| 6,260,558 | B1 * | 7/2001 | Neuner | 132/218 |
| 6,345,626 | B1 | 2/2002 | Bouix | |
| 6,591,842 | B2 * | 7/2003 | Gueret | 132/218 |
| 2002/0014251 | A1 | 2/2002 | Gueret | |
| 2002/0059942 | A1 * | 5/2002 | Neuner et al. | 132/218 |
| 2004/0011375 | A1 | 1/2004 | Dumler | |
| 2005/0034740 | A1 * | 2/2005 | Eckers et al. | 132/218 |
| 2006/0272668 | A1 * | 12/2006 | Wyatt et al. | 132/218 |

FOREIGN PATENT DOCUMENTS

| | | | |
|---|---|---|---|
| DE | 8025937 | U1 | 1/1981 |
| DE | 3114748 | | 12/1982 |
| DE | 10232589 | | 1/2004 |
| EP | 0 038 524 | A2 | 10/1981 |
| EP | 1162036 | A2 | 12/2001 |
| EP | 1 607 020 | A | 12/2005 |
| EP | 1607020 | A1 | 12/2005 |

* cited by examiner

*Primary Examiner* — Rachel R Steitz
(74) *Attorney, Agent, or Firm* — Browdy and Neimark, PLLC

(57) ABSTRACT

In an applicator for a cosmetic product, especially for mascara or hair dye, comprising a main body that is connectable to a handle, said main body having a plurality of discs disposed parallel to one another, spaced apart from one another, provision is made for the discs to be patterned individually user-specifically.

27 Claims, 5 Drawing Sheets

APPLICATION FOR A COSMETIC PRODUCT, ESPECIALLY FOR MASCARA OR HAIR DYE

BACKGROUND OF THE INVENTION

1. Field of the Invention

The invention relates to an applicator for a cosmetic product, especially for mascara or hair dye, comprising a main body that is connectable to a handle, said main body having a plurality of discs disposed parallel to one another, spaced apart from one another.

2. Background Art

An applicator of this type is known, for example, from U.S. Pat. No. 3,892,248, DE 31 14 748 A1, DE 80 25 937 U1, U.S. Pat. No. 4,527,575 A, U.S. Pat. No. 6,345,626 B1 and EP 0 038 524 A.

In contrast to mascara brushes that are produced by helical twisting of wires to secure the bristles, brushes of the above type, which are produced by injection molding open up much greater leeway for the design.

The shaping of the above mentioned known applicators with a plurality of discs was determined primarily by the requirements of the injection-molding and part removal processes.

SUMMARY OF THE INVENTION

Newer injection-molding techniques, on the other hand, allow for a much more individual shaping, which is why the invention has as its object, with the above as the starting point, to improve the application and combing properties by taking advantage of these possibilities.

This object is met with an applicator according to the preamble, in such a way that the disc spacing in the apex region is 0.2 to 2.4 mm, especially 0.2 to 1.6 mm, and in the base region 0.0 to 1.2 mm, especially 0.1 to 0.7 mm.

The discs are preferably patterned application-specifically. This shall be understood to mean that the discs do not have a uniform, strictly disc-shaped geometry in the circumferential direction, but that they are patterned in themselves and especially in their outer edge region. This is based on the realization that the application and combing quality is determined to the greatest extent by the peripheral region of the applicator. Taking this into account, bristles have already been used in helically twisted mascara brushes, for example, whose ends are formed chisel-shaped (see DE 102 589 A1). This development is now logically being continued for brushes that are produced by injection molding. As a result of the inventive dimensioning, a higher than conventional disc density is achieved with respect to a customary trim length of 25.4 mm, and accordingly a particularly good eyelash separation and combing.

In a further development of the invention, provision may be made for the main body to be composed of a first, harder plastic material and the discs of a second, softer plastic material, thus ensuring the longitudinal stability of the applicator on one hand, and attaining advantageous application properties on the other hand.

Provision may additionally be made for the discs to be permeated by one or a plurality of grooves extending in the longitudinal direction. This creates additional reservoirs for the cosmetic product to be applied, while at the same time increasing the combing and separation effect as a result of the radially extending edges that are created in this manner.

The grooves may also be placed offset from disc to disc.

In a preferred embodiment provision is made for the discs to be formed conical in cross section, wherein a concave groove may be provided at the tip of the cone.

Alternatively, the discs may also have outer surfaces that are parallel to each other and they may be rounded semi-circular in cross section in the peripheral region.

As far as discs are mentioned above and below, these may also be referred to as rings, as they can be permeated by a longitudinal cavity.

The discs may also be produced in a two-component injection-molding process, so that they are composed of a softer plastic material, whereas a central body or main body is composed of a harder plastic material.

An additional variant provides that, extending from a substantially conical cross section, a bead-like circumferential thickened area is created in the region of the cone tip.

To achieve a pronounced curling effect, i.e., to curve the eyelashes upward during the combing process, each disc may have a stepped region against which the eyelashes come to rest.

The disc configuration, viewed from above, may preferably be formed round, rectangular, provided with projections, or in the style of a four-leaf clover.

The depth of the grooves between the individual discs is advantageously 0.5 to 3.0 mm, preferably approximately 2.25 mm.

The width of the discs in the base area is advantageously 0.2 to 1.2 mm.

An inventive applicator may be produced by means of one-component or two-component injection-molding with a combination of TPE or TPU, in particular, being materials of interest for the discs, and PP, PE, POM, PBT, PA for the main body. The main body may also be produced from a metal tube.

If the applicator is produced from a plastic material, preferably PE, PP, PA, PBT or polyester and polyacrylic is preferred.

The invention will be explained in more detail below, based on a preferred example embodiment in conjunction with the drawing.

DESCRIPTION OF THE PREFERRED EMBODIMENT

Figures 1A, 1B, 1C, 1D, 1E, 1F:
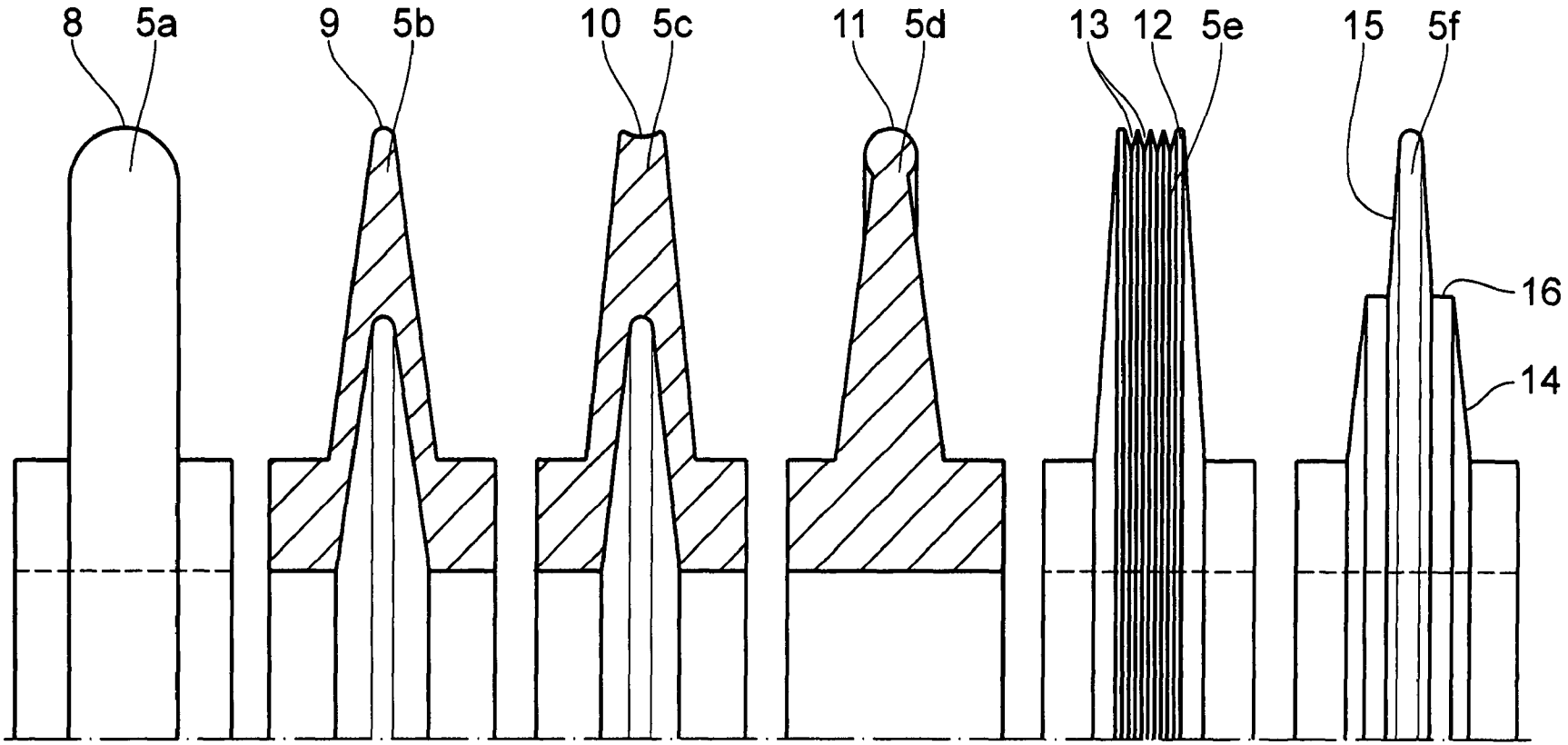
FIGS. 1*a* through 1*f* shows a cross section through an individual disc in each case and view from above, to illustrate different disc patterns.

An inventive mascara brush 1 comprises a rod-like oblong main body 2 having a connecting section 3 for fastening it to a handle. The trim 4 consists of a plurality of discs 5 that are integrally connected to the disc base as one piece, wherein longitudinally extending concave grooves 6 are optionally provided, between which convexly arched crests 7 are formed.

FIG. 1*a* shows a first cross-sectional configuration of a disc 5*a* having plane-parallel side walls and a semi-circular periphery 8.

In the embodiment according to FIG. 1*b* the disc 5*b* is cone shaped in cross section with a rounded periphery 9. This embodiment is particularly preferred.

In this embodiment, but also in other embodiments that are described here, the width of the disc bases at their points of transition into the main body 2 is 0.2 mm to 1.2 mm, the spacing of the base regions of two adjacent discs is 0.0 mm to 1.2 mm, the spacing between the tips of the discs or of the center longitudinal lines of two adjacent tips is 0.2 mm to 2.4 mm, the effective disc height is 0.5 mm to 8.0 mm, especially 1.5 mm to 1.7 mm, the diameter of each disc is 4.0 mm to 15 mm, a number of discs is 127 to 140 relative to a "trim length" of 25.4 mm or, in other words, a disc density of 5 to 50 discs per 10 mm, the trim length being between 10 mm and 100 mm. The cone angle is 0.75° to 99°, especially 0.75° to 2.5°, and the tip radius of curvature is 0.025 mm to 0.5 mm.

FIG. 1*c* shows a modification of FIG. 1*b* having a groove 10 on the periphery.

In the embodiment shown in FIG. 1*d*, the disc 5*d* is also cone shaped in cross section, however it has a rounded thickened region on its periphery 11.

The embodiment according to FIG. 1*e* shows a disc 5*e* that is cone shaped in cross section and has a periphery 12 having a plurality of circumferential grooves 13.

The embodiment according to FIG. 1*f* shows a disc 5*f* having conical flanks 14 and 15, which are interrupted by a stepped region 16 for achieving a curling effect.

Figure 2:
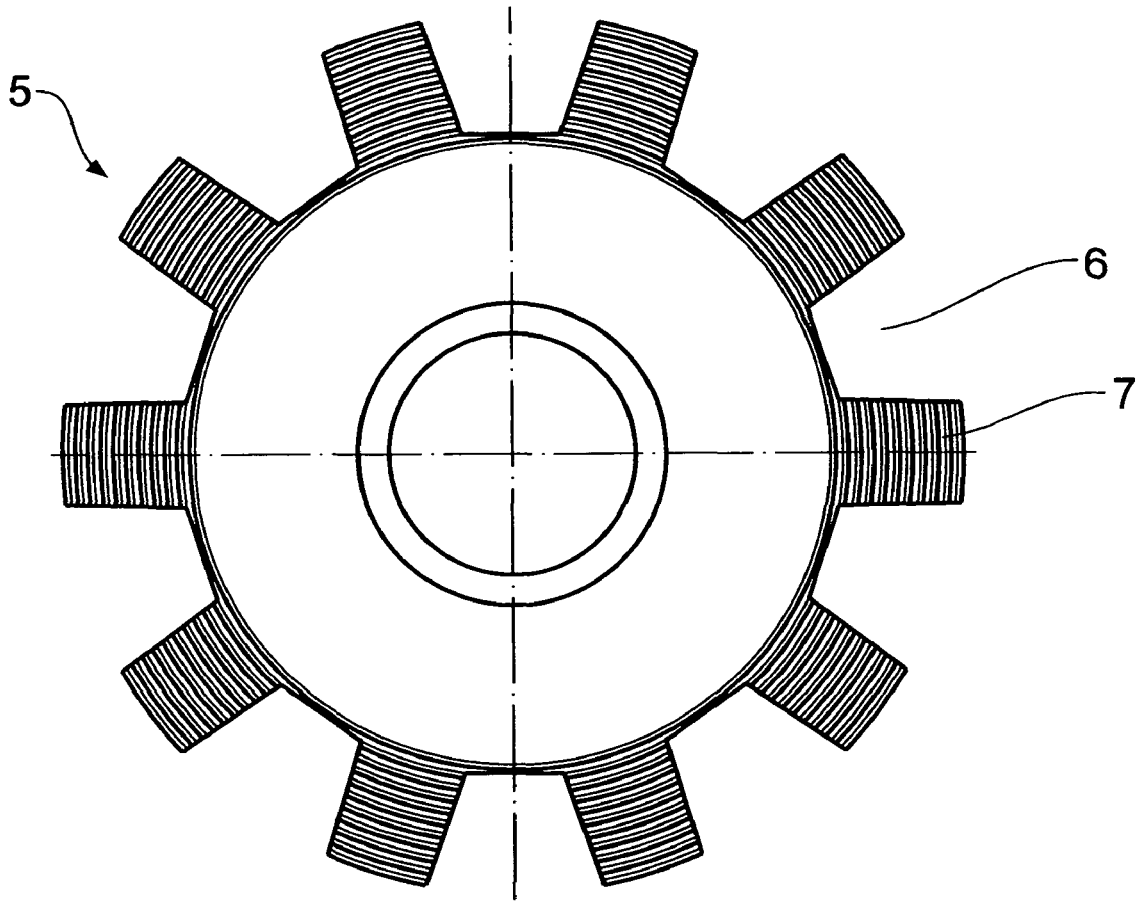
FIG. 2 shows a view from above of an individual disc with radial grooves.
Figure 3:
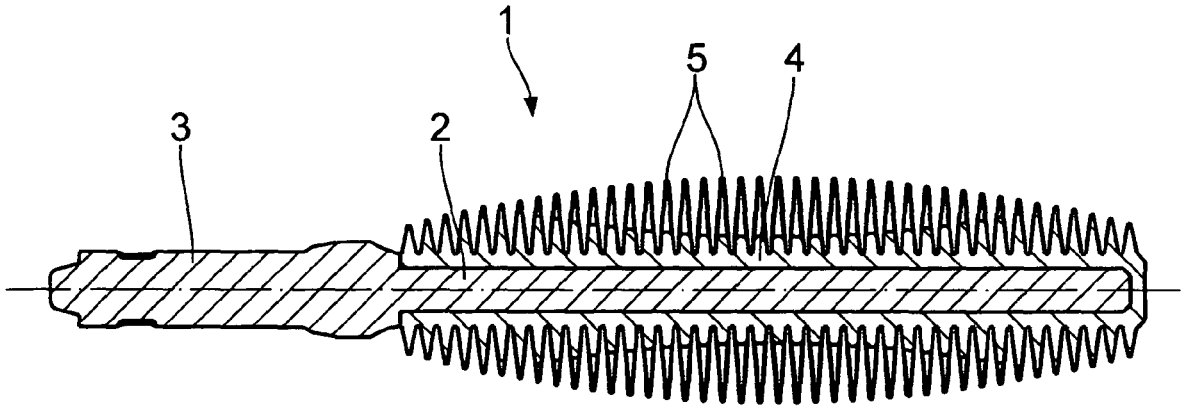
FIG. 3 shows a longitudinal section through a complete inventive mascara brush.

FIG. 2 shows a sectional view through a disc 5 wherein a plurality of radial grooves 6 are provided between which crests 7 are formed.

Figure 4:
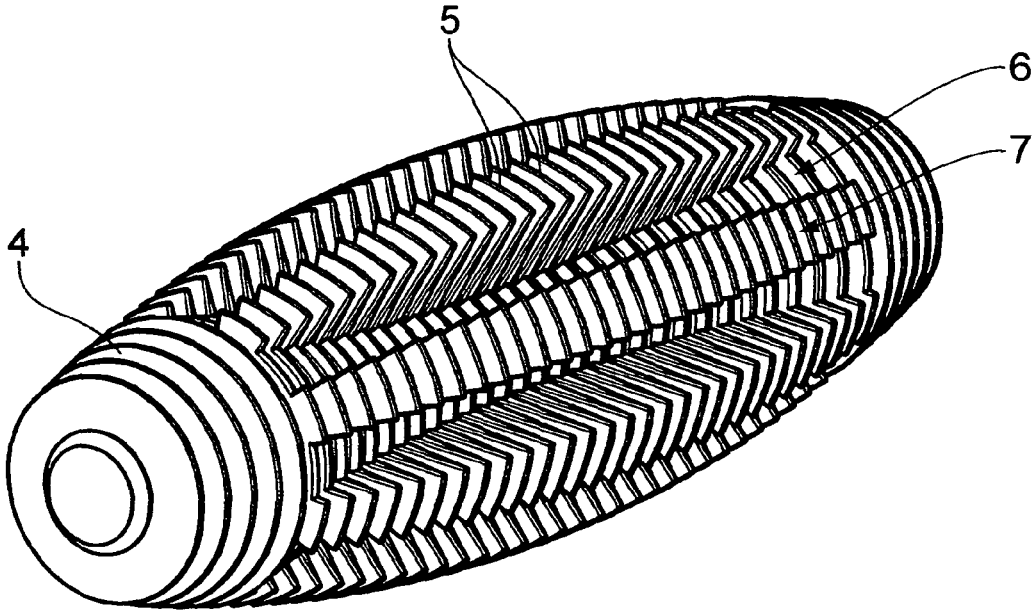
FIG. 4 shows a perspective view of the trim made up of discs.

The grooves 6 do not necessarily need to be implemented continuous in the longitudinal direction as shown in FIG. 4, but they may also be implemented offset from disc to disc.

Figure 5:
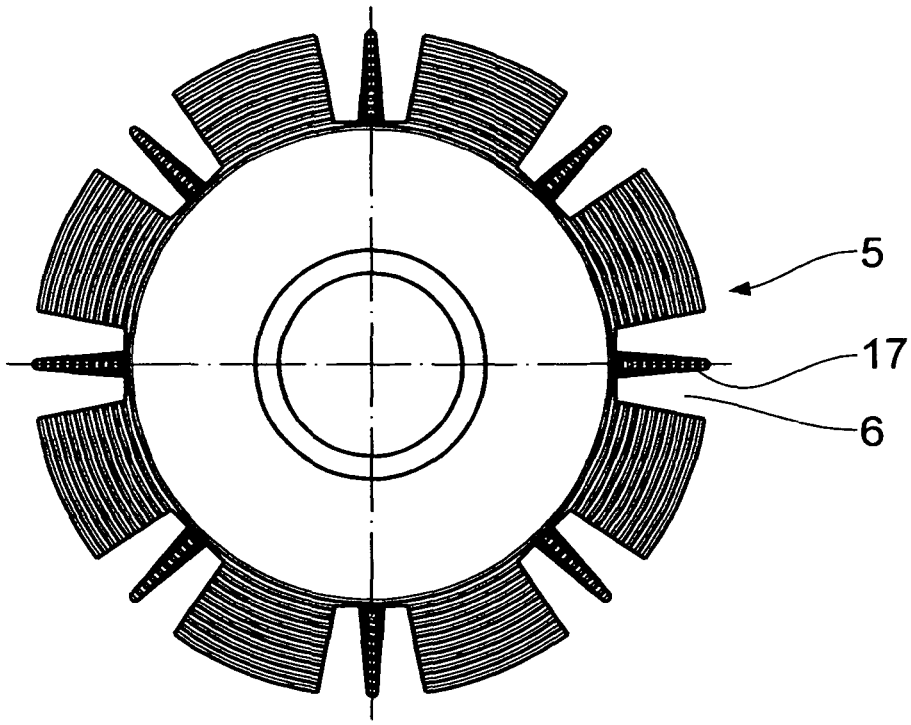
FIGS. 5 through 7 show various cross-sectional configurations of the discs with the sections extending through the disc plane.

Depicted in FIG. 5 is a disc 5 that has cavities or grooves 6, a bristle 17 being disposed in the center of each cavity or groove 6.

Figure 6:
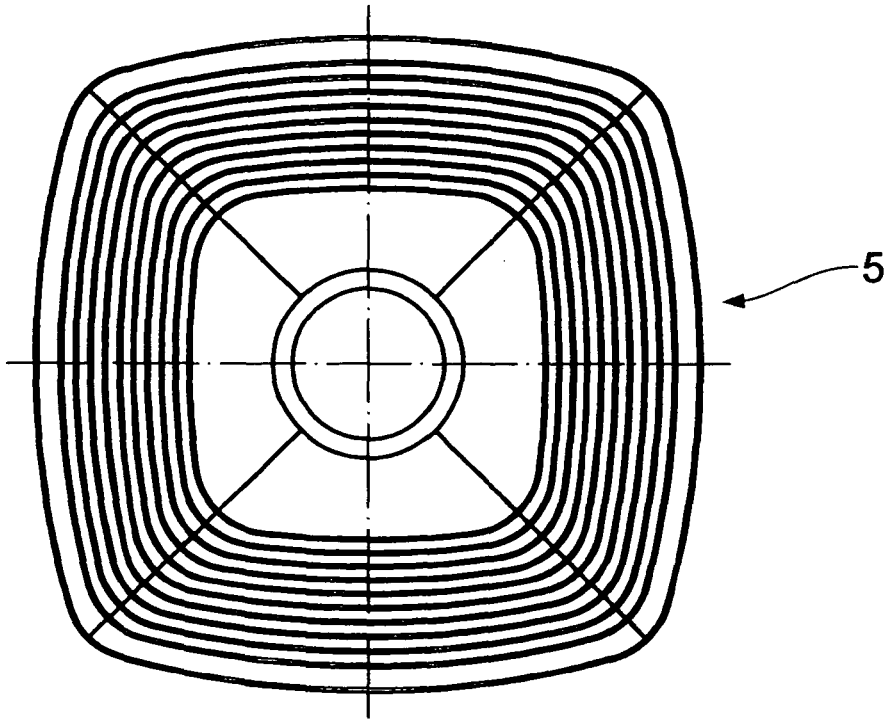

In the embodiment according to FIG. 6, provision is made for the discs 5 to have an approximately square cross section with rounded side surfaces.

Figure 7:
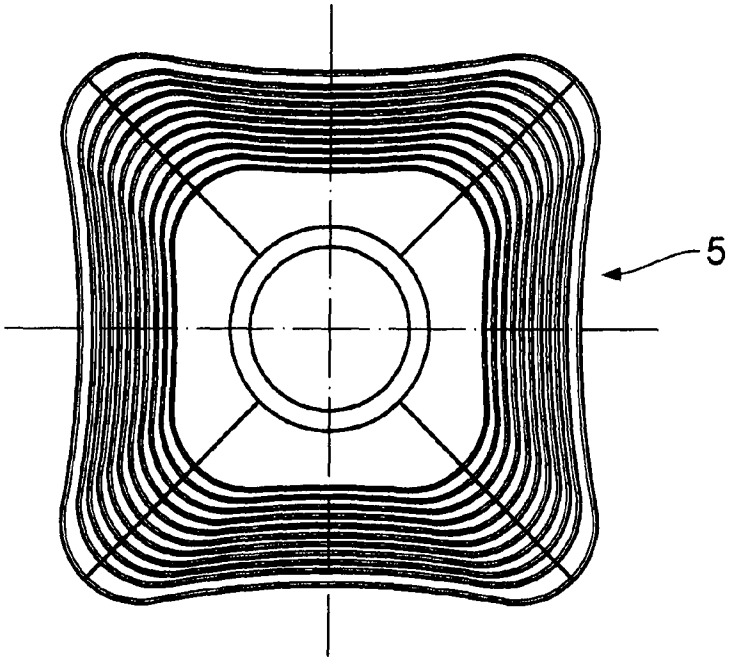

In the embodiment according to FIG. 7, the discs also have a substantially square cross section, the side surfaces being formed concave and the corner regions rounded.

Figure 8:
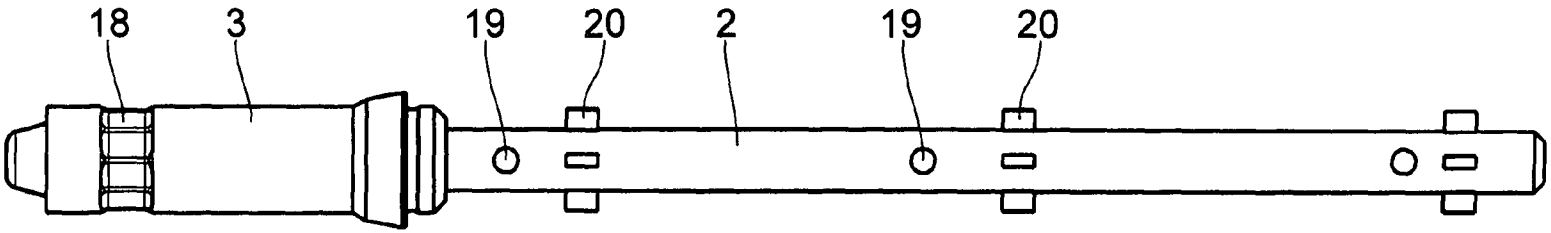
FIG. 8 shows a view from above of an advantageous embodiment of the main body.

FIG. 8 depicts a main body 2 with a handle extension 3, which has a region 18 that is pentagonal in cross section. The main body 2 is hollow inside and has a plurality of outlet orifices 19. Accordingly, it is possible to inject through the longitudinal cavity and through the passage orifices 19 in a two-component injection-molding process a second component, especially a softer component, to create the discs 5. The main body 2 has projections 20 that prevent the bristle body from being pulled off in the axial direction.

In addition to, or in deviation from the above described example embodiments, provision may be made for the discs and for their central region to be injection molded as one piece from one material, or also for the central region to be composed of a first plastic material and for the discs to be injection-molded onto the same, for example of a softer plastic material, using two-component injection-molding technology.

The discs may have along their circumference at least one cutout, in such a way that a plurality of axially successive cutouts of consecutive discs may form a groove.

Provision may additionally be made for one or a plurality of bristles to be provided in the region of the disc cutouts. Viewed in the longitudinal direction, discs and bristle rings may also be provided alternatingly.

The main body may be polygonal in cross section, at least along a section of it, for fastening it to a handle, in order to thus attain a twist-proof assembly.

What is claimed is:

1. An applicator for a cosmetic product such as mascara or hair dye, comprising:

a main body that is connectable to a handle, a trim having a disc base and a plurality of discs having smooth side surfaces, said trim being fixed to said main body, said discs being integrally connected to said disc base as one piece, and said discs being disposed parallel to one another and fixedly spaced apart from one another, wherein a fixed space between the discs in an apex region is between 0.2 to 1.6 mm, and in a base region between 0.1 to 0.7 mm, wherein a tip radius curvature of the discs is 0.025 to 0.5 mm, and wherein the main body extends into an application area formed by the discs, and the main body is composed of a first, harder plastic material providing longitudinal stability for said applicator, and the discs are composed of a second, softer plastic material, the harder material being harder than the softer material, and further wherein each of said discs has two opposed sides each of conical form and a periphery provided with a thickened region in the form of a bead.

2. An applicator according to claim 1, wherein the discs (5) are intersected by one or a plurality of grooves (6) extending in a longitudinal direction of the main body and down to a base region, wherein the grooves (6) may be placed offset from disc (5) to disc (5).

3. An applicator according to claim 2, wherein a depth of the grooves between the individual discs (5) is 0.5 to 3.0 mm.

4. An applicator according to claim 3, wherein the depth of the grooves between the individual discs (5) is 2.25 mm.

5. An applicator according to claim 1, wherein the discs (5) viewed from an end of the main body in the direction of a longitudinal axis of the main body are formed round, rectangular, provided with projections, or in the style of a four-leaf clover.

6. An applicator according to claim 1, wherein a width of the discs (5) in the base region is 0.2 to 1.2 mm.

7. An applicator according to claim 1, wherein the applicator is produced by two-component injection molding, one component being TPE and the other component being TPU.

8. An applicator according to claim 1, wherein the cone angle of the conical cross section is 0.75° to 99°.

9. An applicator according to claim 8, wherein the cone angle is 0.75° to 25°.

10. An applicator for a cosmetic product such as mascara or hair dye, comprising:

a main body that is connectable to a handle, a trim having a disc base and a plurality of discs having smooth side surfaces, said trim being fixed to said main body, said discs being integrally connected to said disc base as one piece, and said discs being disposed parallel to one another and fixedly spaced apart from one another, wherein a fixed space between the discs in an apex region is between 0.2 to 1.6 mm, and in a base region between 0.1 to 0.7 mm, wherein a tip radius curvature of the discs is 0.025 to 0.5 mm, and wherein the main body extends into an application area formed by the discs, and the main body is composed of a first, harder plastic material providing longitudinal stability for said applicator, and the discs are composed of a second, softer plastic material, the harder material being harder than the softer material, and further wherein each of said discs has two opposed sides each of conical form and a periphery provided with a plurality of circumferential grooves.

11. An applicator according to claim 10, wherein the discs (5) are intersected by one or a plurality of grooves (6) extending in a longitudinal direction of the main body and down to a base region, wherein the grooves (6) may be placed offset from disc (5) to disc (5).

12. An applicator according to claim 11, wherein a depth of the grooves between the individual discs (5) is 0.5 to 3.0 mm.

13. An applicator according to claim 12, wherein the depth of the grooves between the individual discs (5) is 2.25 mm.

14. An applicator according to claim 10, wherein the discs (5) viewed from an end of the main body in the direction of a longitudinal axis of the main body are formed round, rectangular, provided with projections, or in the style of a four-leaf clover.

15. An applicator according to claim 10, wherein a width of the discs (5) in the base region is 0.2 to 1.2 mm.

16. An applicator according to claim 10, wherein the applicator is produced by two-component injection molding, one component being TPE and the other component being TPU.

17. An applicator according to claim 10, wherein the cone angle of the conical cross section is 0.75° to 99°.

18. An applicator according to claim 17, wherein the cone angle is 0.75° to 25°.

19. An applicator for a cosmetic product such as mascara or hair dye, comprising:

a main body that is connectable to a handle and that has a longitudinal axis, a trim having a disc base and a plurality of discs having smooth planar side surfaces, said trim being fixed to said main body, said discs being integrally connected to said disc base as one piece, and said discs being disposed parallel to one another and fixedly spaced apart from one another, wherein a fixed space between the discs in an apex region is between 0.2 to 1.6 mm, and in a base region between 0.1 to 0.7 mm, wherein a tip radius curvature of the discs is 0.025 to 0.5 mm, and wherein the main body extends into an application area formed by the discs, and the main body is composed of a first, harder plastic material providing longitudinal stability for said applicator, and the discs are composed of a second, softer plastic material, the harder material being harder than the softer material, and further wherein each of said discs viewed in a cross sectional plane parallel to the longitudinal axis has, at each side of said disc, two radially spaced conical flanks interrupted by a stepped region.

20. An applicator according to claim 19, wherein the discs (5) are intersected by one or a plurality of grooves (6) extending in a longitudinal direction of the main body and down to a base region, wherein the grooves (6) may be placed offset from disc (5) to disc (5).

21. An applicator according to claim 19, wherein the discs (5) viewed from an end of the main body in the direction of a longitudinal axis of the main body are formed round, rectangular, provided with projections, or in the style of a four-leaf clover.

22. An applicator according to claim 19, wherein a depth of the grooves between the individual discs (5) is 0.5 to 3.0 mm.

23. An applicator according to claim 22, wherein the depth of the grooves between the individual discs (5) is 2.25 mm.

24. An applicator according to claim 19, wherein a width of the discs (5) in the base region is 0.2 to 1.2 mm.

25. An applicator according to claim 19, wherein the applicator is produced by two-component injection molding, one component being TPE and the other component being TPU.

26. An applicator according to claim 19, wherein the cone angle of the conical cross section is 0.75° to 99°.

27. An applicator according to claim 26, wherein the cone angle is 0.75° to 25°.

* * * * *